US006522230B2

(12) United States Patent
Hanato et al.

(10) Patent No.: US 6,522,230 B2
(45) Date of Patent: Feb. 18, 2003

(54) CHIP-TYPE COMMON MODE CHOKE COIL

(75) Inventors: Yoshio Hanato, Sabae (JP); Kazuo Kasahara, Miyagi-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/906,250

(22) Filed: Jul. 16, 2001

(65) Prior Publication Data

US 2002/0057160 A1 May 16, 2002

(30) Foreign Application Priority Data

Jul. 17, 2000 (JP) ..... 2000-215429

(51) Int. Cl.[7] ..... H01F 5/00; H01F 27/02

(52) U.S. Cl. ..... 336/83; 336/200; 336/223; 336/232; 336/198; 336/192

(58) Field of Search ..... 336/200, 223, 336/232, 83, 192, 198, 208

(56) References Cited

U.S. PATENT DOCUMENTS 4,777,461 A * 10/1988 Sakamoto ..... 333/184
5,821,843 A * 10/1998 Mamada et al. ..... 336/83
6,154,112 A * 11/2000 Aoba et al. ..... 336/192
6,348,850 B1 * 2/2002 Kimura et al. ..... 336/200
6,373,366 B1 * 4/2002 Sato et al. ..... 336/192
6,388,550 B1 * 5/2002 Kanetaka et al. ..... 336/223

* cited by examiner

*Primary Examiner*—Anh Mai
(74) *Attorney, Agent, or Firm*—Keating & Bennett, LLP

(57) ABSTRACT

A chip-type common mode choke coil having protrusions extending in an axial direction of a winding core portion and being formed in areas between a plurality of electrodes (four electrodes), at the inside surfaces of two flanges, that is, at opposing surfaces of the two flanges, one being disposed on each end of the winding core portion, in order to increase the stroke distances between the corresponding electrodes. In the choke coil, the protrusions separate the corresponding electrodes in order to prevent the occurrence of a short circuit caused by two wires also coming into contact with the electrodes adjacent to the electrodes to which they are primarily to be connected. For the protrusions, protrusions having at least one of a triangular shape, a square shape, a rectangular shape, a trapezoidal shape, and a substantially semicircular shape in plan view are disposed. Accordingly, the chip-type common mode choke coil makes it possible to prevent the occurrence of a short circuit caused by the wires coming into contact with the corresponding adjacent electrodes, the occurrence of reduced withstand pressure, and the occurrence of insufficient insulation. In addition, it can have high mechanical strength as a result of increased cross-sectional areas of the legs, and be highly reliable.

20 Claims, 12 Drawing Sheets

CHIP-TYPE COMMON MODE CHOKE COIL

BACKGROUND OF THE INVENTION

1. Field of the Invention

The present invention relates to a common mode choke coil used for removing noise having the same phase components transmitted from a power supply line or a signal line, and, more particularly, the present invention relates to a small, surface-mountable chip-type common mode choke coil which is used in various electronic circuits.

2. Description of the Related Art

A chip-type common mode choke coil having a winding is available as a chip-type common mode choke coil. In the winding type, a wire is wound upon a winding core portion, and a first end terminal and a second end terminal of the wire are connected to electrodes provided on flanges, one being provided on each end of the winding core portion.

There is one kind of conventional winding, chip-type common mode choke coil formed in the following way. For example, as shown in FIGS. 8A and 8B, flanges 53 are disposed, one on each end of a winding core portion 52. In addition, using immersion, for example, electrode films 56 are applied to legs 55 having grooves 54 on the flanges 53 in order to form four leg-shaped electrodes 57*a*, 57*b*, 57*c*, and 57*d*, whereby a core 51 is produced. Using the core 51, as shown in FIG. 9, two wires 58*a* and 58*b* are wound upon the winding core portion 52 in order to electrically connect the first and second end terminals thereof to the corresponding electrodes (the electrodes 57*c* and 57*d* in FIG. 9) by, for example, thermocompression bonding. Then, as shown in FIG. 10, a top plate 60 is mounted so as to cover the top surface of the resulting structure.

However, in the above-described conventional chip-type common mode choke coil, since the grooves 54 are provided in the flanges 53, each of the legs 55 is thin (that is, has a small cross-sectional area in plan view), so that each of the legs 55 may not have sufficient mechanical strength. This results in the problem that the choke coil is not sufficiently reliable.

In connecting exposed conductors (wire bodies) 59*a* and 59*b* of the terminals of the corresponding wires 58*a* and 58*b* to the corresponding leg-shaped electrodes 57*a* to 57*d*, the problem that the wire 58*a* comes into contact with the electrode 57*d* adjacent to the electrode 57*c* at, for example, location A, and is, thus, shorted arises. Even if the wire 58*a* does not come into contact with the electrode 57*d*, the problems of reduced withstand pressure and insufficient insulation occur when it cannot be separated therefrom by a sufficient distance.

There is another kind of conventional winding, chip-type common mode choke coil that is produced in the following manner. For example, as shown in FIG. 11, flanges 53 without grooves are provided, one on each end of a winding core portion 52, and a plurality of electrodes 57*a*, 57*b*, 57*c*, and 57*d* are disposed on the corresponding flanges 53 at predetermined intervals so as not to be brought into electrical conduction with each other, whereby a core 51*a* is produced. Using the core 51*a*, as shown in FIG. 12, the beginning end and the termination end of each of the two wires 58*a* and 58*b* wound upon the winding core portion 52 are electrically connected to the predetermined electrodes (the electrodes 57*c* and 57*d* in FIG. 12) by, for example, thermocompression bonding. Then, as shown in FIG. 13, a top plate 60 is mounted so as to cover the top surface of the resulting structure.

In this kind of chip-type common mode choke coil, since grooves are not provided in the flanges 53, the mechanical strengths of the legs are high. However, as shown in FIG. 12, when the wires 58*a* and 58*b* are joined to the electrodes 57*c* and 57*d*, a high-temperature heater chip 61 used for removing the films of the wires 58*a* and 58*b* may remove not only the portions thereof that are connected to the electrodes 57*c* and 57*d*, but also the film of a nearby portion 62. This may, in particular, cause an exposed conductor 59*b* (wire body) of the wire 58*b* to get shorted to respect to the adjacent electrode 57*c*, so that the choke coil has very low reliability.

The problem that a short circuit failure tends to occur similarly occurs in the previously described choke coil shown in FIGS. 8 to 10.

Although, in the two conventional examples, the two-circuit, chip-type common mode choke coils are described as having the aforementioned problems, chip-type common mode choke coils having three or more circuits also have the aforementioned problems.

In addition, although, in the two conventional examples, chip-type common mode choke coils that are provided with top plates are described as having the aforementioned problems, chip-type common mode choke coils which are not provided with top plates also have the aforementioned problems.

SUMMARY OF THE INVENTION

In order to overcome the problems described above, preferred embodiments of the present invention provide a highly reliable chip-type common mode choke coil which prevents a wire from being short-circuited as a result of coming into contact with an adjacent electrode, prevents the withstand pressure from being reduced, and ensures sufficient insulation, while providing sufficiently high mechanical strength because its legs have large cross-sectional areas.

According to a preferred embodiment of the present invention, a chip-type common mode choke coil includes a winding core portion, flanges disposed on both ends of the winding core portion, respectively, a plurality of electrodes disposed on each of the flanges at a predetermined distance from each other so as not to come into electrical conduction with each other, and a plurality of wires wound upon the winding core portion, beginning ends and termination ends of the wires being connected to predetermined electrodes of the plurality of electrodes, wherein protrusions which protrude in an axial direction of the winding core portion are provided in areas between the respective electrodes, at inside surfaces of the respective flanges disposed on both ends of the winding core portion.

By arranging protrusions to protrude in the axial direction of the winding core portion in areas between the corresponding electrodes, at the inside surfaces of the flanges, the stroke distances between the adjacent electrodes are increased, and the adjacent electrodes can be separated from each other by the corresponding protrusions. Therefore, it is possible to reliably prevent the occurrence of a short circuit caused by the wires coming into contact with not only the electrodes to which they are primarily to be connected, but also with the electrodes adjacent thereto.

Therefore, even in the case where not only the portions of the films of the wires which are connected to the electrodes, but also nearby portions thereof are removed when the wires are joined to the corresponding electrodes, for example, by pushing a high-temperature heater chip against the wires, it is possible to prevent the occurrence of a short circuit caused by the wires coming into contact with the corresponding adjacent electrodes, and the occurrence of reduced insulation resistance. Therefore, it is possible to obtain a highly reliable chip-type common mode choke coil.

Since the cross-sectional areas of the flanges (that is, the legs) become larger in correspondence with the protrusions, it is possible to obtain a highly reliable chip-type common mode choke coil having excellent mechanical strength.

In the description of preferred embodiments of the present invention, the phrase "areas between the corresponding electrodes, at the inside surfaces of the flanges" is to be broadly interpreted to refer to the areas between the corresponding electrodes and the areas in the vicinity thereof when the electrodes are disposed on the inside surfaces of the flanges (that is, the opposing surfaces of the two flanges), and to the areas of the inside surfaces of the flanges connected to (formed in correspondence with) the areas between the electrodes on the bottom surfaces when the electrodes are disposed on only the bottom surfaces of the flanges.

The shape in plan view of the protrusion provided on each flange may be at least one of a substantially triangular shape, a substantially rectangular shape, a substantially square shape, a substantially trapezoidal shape, and a substantially semicircular shape.

In preferred embodiments of the present invention, although the shape of the protrusion disposed on each of the flanges is not particularly limited, when it is at least one of a substantially triangular shape, a substantially square shape, a substantially rectangular shape, a substantially trapezoidal shape, and a substantially semicircular shape in plan view, it is possible for the protrusions to increase the stroke distances between adjacent electrodes, to reliably separate the adjacent electrodes, and to prevent the occurrence of short circuits caused by the wires not only coming into contact with the electrodes to which they are primarily to be connected, but also with the electrodes adjacent thereto. Therefore, preferred embodiments of the present invention provide much more effective components.

In the present invention, the shape of each protrusion in plan view may be a combination of at least two of a substantially polygonal shape, such as a substantially triangular shape or a substantially square shape, a substantially trapezoidal shape, a substantially semicircular shape, and other suitable shapes.

Other features, elements, characteristics and advantages of the present invention will become more apparent from the detailed description of preferred embodiments thereof with reference to the attached drawings.

DETAILED DESCRIPTION OF PREFERRED EMBODIMENTS

Hereunder, the features of the present invention will be described with reference to preferred embodiments thereof.

Figure 1:
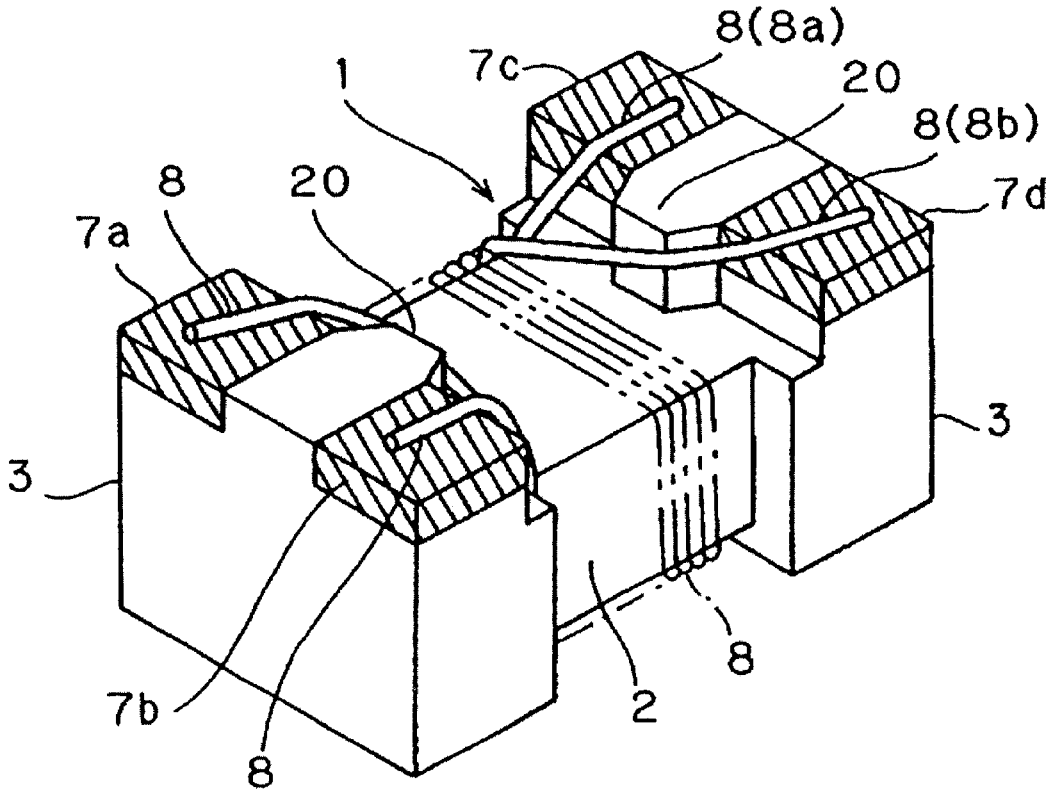
FIG. 1 is a perspective view of a preferred embodiment of a chip-type common mode choke coil in accordance with the present invention.
Figure 2:
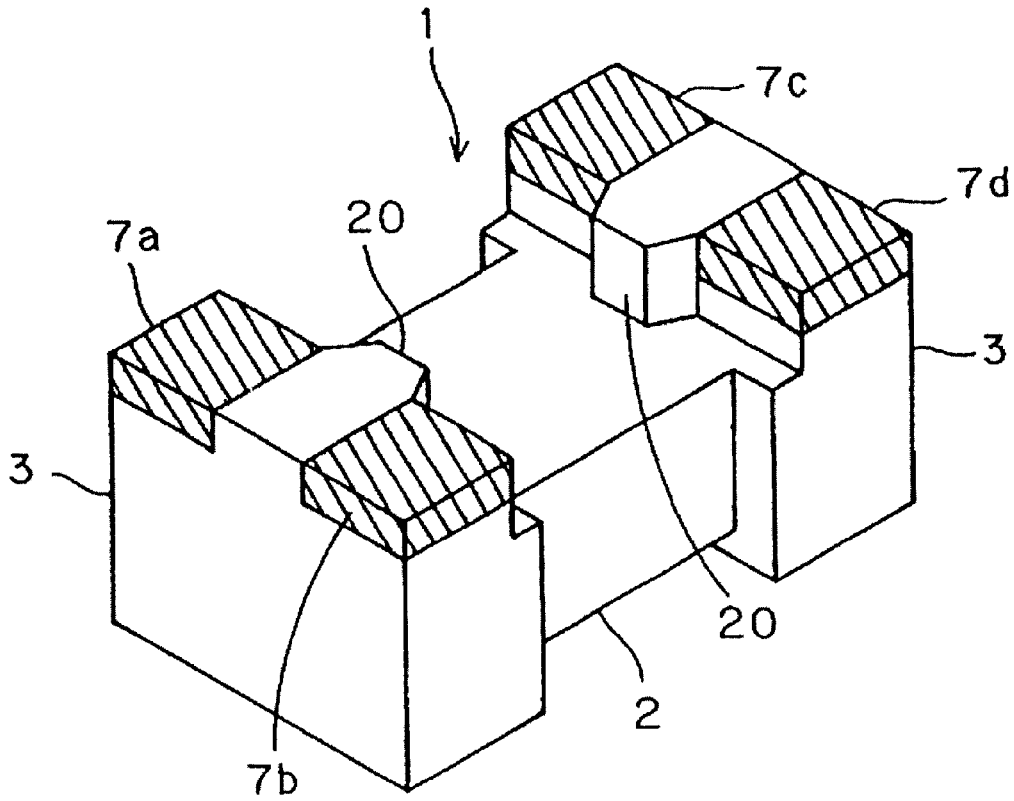
FIG. 2 is a perspective view of the structure of a core used for the chip-type common mode choke coil shown in FIG. 1.

FIG. 1 is a perspective view of a two-circuit, four terminal, chip-type common mode choke coil according to a preferred embodiment in accordance with the present invention. FIG. 2 is a perspective view of the structure of a core used for the chip-type common mode choke coil shown in FIG. 1.

As shown in FIG. 2, a core 1 included in the present preferred embodiment is preferably made of a ferrite material. In the core 1, a pair of flanges 3 are disposed, one on each end of a winding core portion 2. In addition, electrode films are applied to two locations of each flange 3, so that the core 1 includes a total of four electrodes 7*a*, 7*b*, 7*c*, and 7*d*.

In the core 1, protrusions 20 which preferably have substantially trapezoidal shapes in plan view and which protrude in the axial direction of the winding core portion 2 are provided in the area between the electrodes 7*a* and 7*b* and in the area between the electrodes 7*c* and 7*d*, respectively, at the inside surfaces of the flanges 3 (that is, at the opposing surfaces of the pair of flanges 3, one being disposed on each end of the winding core portion 2).

As shown in FIG. 1, two wires 8*a* and 8*b* are wound upon the winding core portion 2 of the core 1, and the beginning end side and the termination end side terminals thereof are electrically connected to the corresponding electrodes 7*a*, 7*b*, 7*c*, and 7*d* by, for example, thermocompression bonding in order to produce the two-circuit, four-terminal, chip-type common mode choke coil.

As described above, in the present preferred embodiment of the chip-type common mode choke coil, the protrusions 20 are preferably disposed in the area between the electrodes 7*a* and 7*b* and in the area between the electrodes 7*c* and 7*d*, respectively, at the inside surfaces of the flanges 3. The wires 8*a* and 8*b* are connected to the predetermined electrodes 7*a* to 7*d* as a result of extending around the predetermined electrode 7*a* to 7*d* sides, along the protrusions 20. In addition, the adjacent electrodes 7*a* and 7*b* and the adjacent electrodes 7*c* and 7*d* are separated by the corresponding protrusions 20, so that the wires 8*a* and 8*b* do not come as close to the electrodes adjacent to the electrodes to which they are connected as to cause a short circuit failure and reduced insulation resistance. Therefore, it is possible to obtain a highly reliable chip-type common mode choke coil.

Even if the linear distances between the electrodes are the same, the stroke distances are large. Since the two sets of adjacent electrodes are separated by their corresponding protrusions 20, even in the case where a method of pushing a high-temperature heater chip against the wires is used to join the wires to the electrodes, it is possible to effectively restrict or prevent the occurrence of a short circuit caused by the conductors exposed by the removal of the films of the wires (that is, the wire bodies) coming into contact with the electrodes adjacent to the electrodes to which the wires are to be joined, and the occurrence of reduced insulation resistance.

Since the wires 8*a* and 8*b* are routed along the protrusions 20 in a relatively gradually bent state, it is easier to restrict or prevent the breakage of the wires than when a core is not provided with protrusions.

Since the protrusions 20 are provided, the cross-sectional areas of the flanges 3 (that is, the legs) become larger correspondingly, making it possible to obtain a highly reliable chip-type common mode choke coil having legs with excellent mechanical strength.

Although the chip-type common mode choke coil shown in FIG. 1 is not provided with a top plate, it may be provided with a top plate.

FIGS. 3 to 6 each illustrate modifications of the core used for the chip-type common mode choke coil of preferred embodiments of the present invention.

Figure 3:
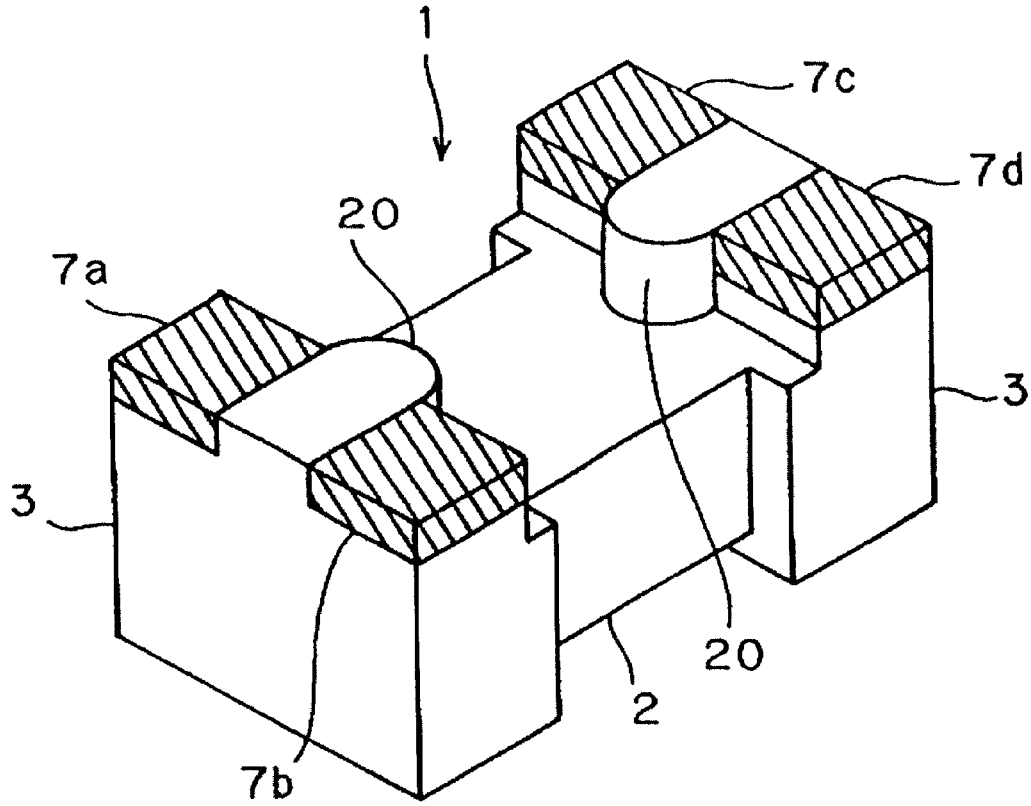
FIG. 3 shows a modification of the core used for the chip-type common mode choke coil in accordance with preferred embodiments of the present invention.

FIG. 3 illustrates a core 1 having protrusions 20 that are substantially semicircular in plan view and are disposed on the inside surfaces of the flanges 3.

Figure 4:
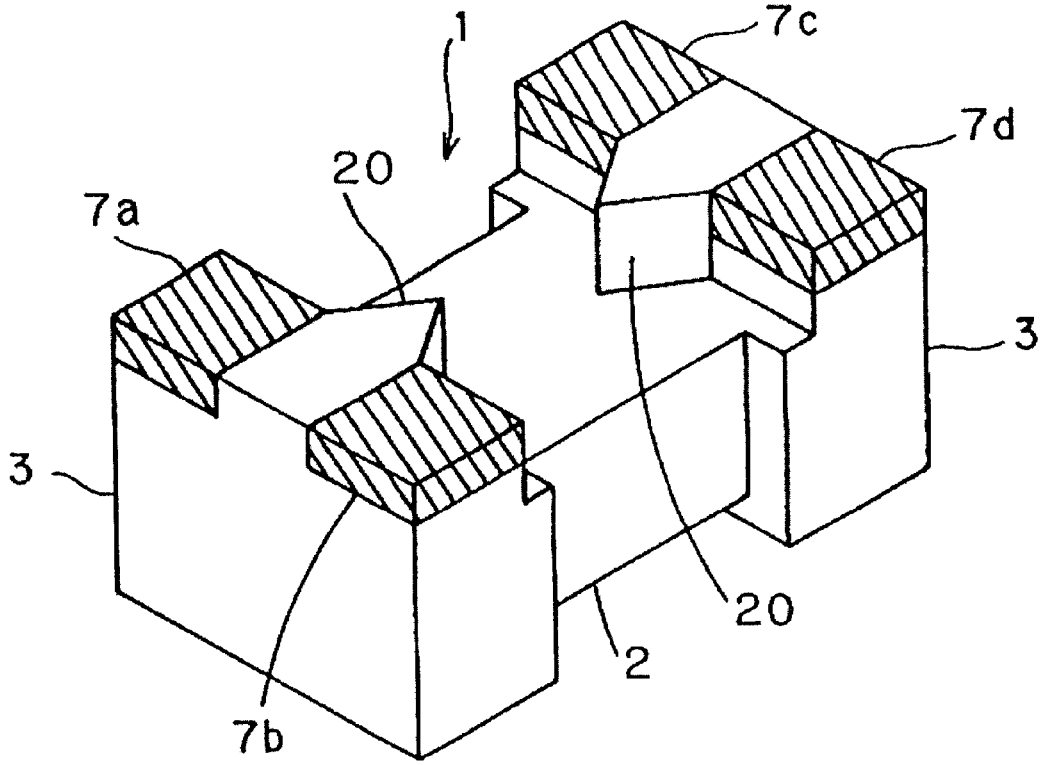
FIG. 4 shows another modification of the core used for the chip-type common mode choke coil in accordance with preferred embodiments of the present invention.

FIG. 4 illustrates a core 1 having protrusions 20 that are substantially triangular in plan view and are provided on the inside surfaces of the flanges 3.

Figure 5:
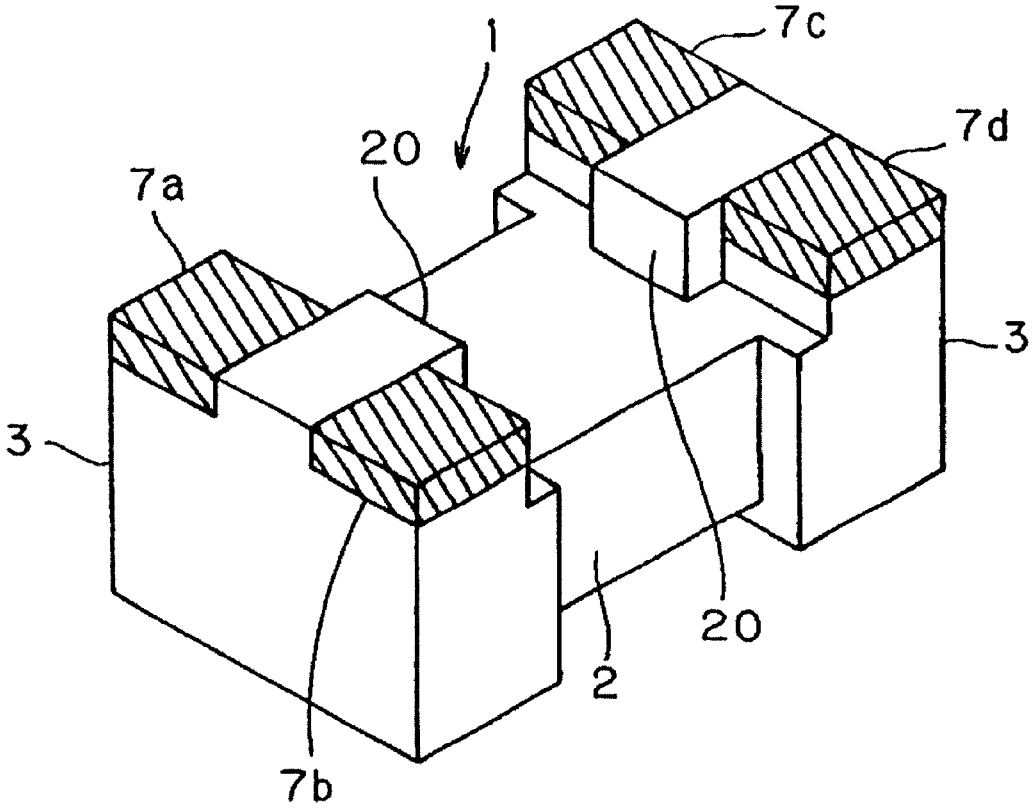
FIG. 5 shows still another modification of the core used for the chip-type common mode choke coil in accordance with preferred embodiments of the present invention.

FIG. 5 illustrates a core 1 having protrusions 20 that are substantially rectangular (that is, substantially square-shaped) in plan view and are provided on the inside surfaces of the flanges 3.

Figure 6:
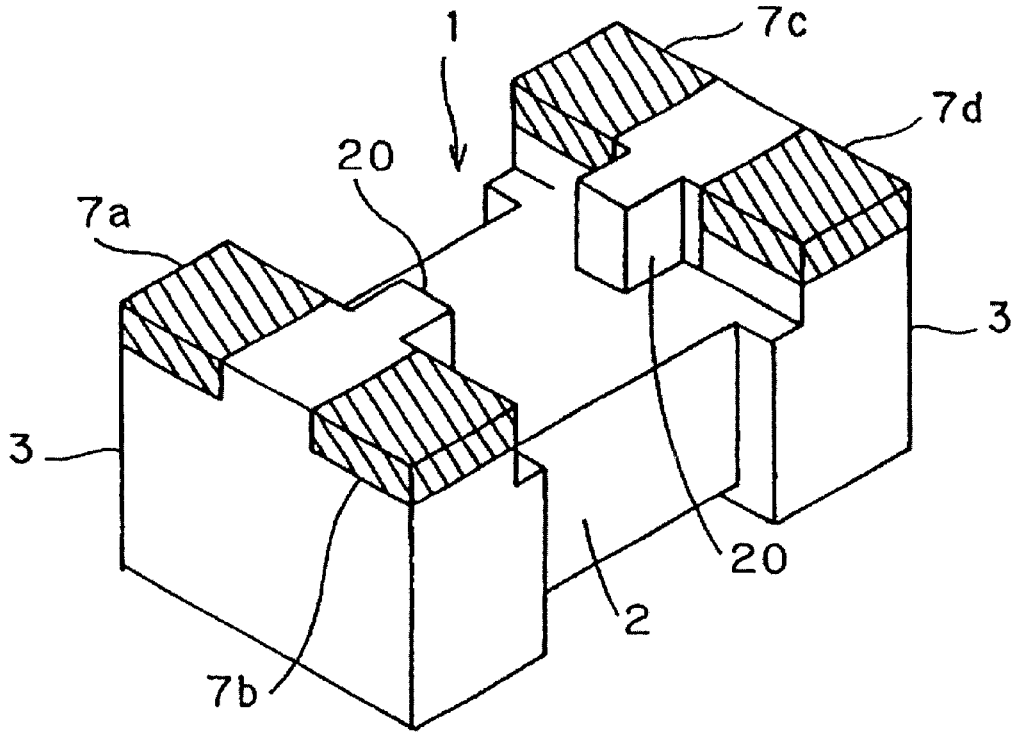
FIG. 6 shows still another modification of the core used for the chip-type common mode choke coil in accordance with preferred embodiments of the present invention.

FIG. 6 illustrates a core 1 having protrusions 20 that are substantially rectangular (that is, substantially square-shaped) and that have smaller widths than the distances between the corresponding electrodes and are disposed on the inside surfaces of the flanges 3.

In FIGS. 3 to 6, elements that are the same as those in FIGS. 1 and 2 are indicated with the same reference numerals as those used to indicate the elements in FIGS. 1 and 2.

In the chip-type common mode choke coil of preferred embodiments of the present invention, the shapes of the protrusions 20 are not particularly limited, so that they may have various other shapes as long as the protrusions 20 allow large stroke distances to be provided between the corresponding adjacent electrodes and are capable of preventing, as a result of separating the adjacent electrodes, the wires from coming into contact with the electrodes adjacent to the electrodes to which they are primarily connected.

The top surfaces of the protrusions 20 do not have to be located at the same heights as the top surfaces of the corresponding electrodes 7*a* to 7*d*, so that, they may be lower than the electrodes 7*a* to 7*d* as required, or may be higher than the electrodes 7*a* to 7*d*. The thicknesses of the protrusions 20 (that is, the distances in a direction that is substantially perpendicular to the axial direction of the winding core portion 2) are not particularly limited, so that they may be changed.

Although the above-described preferred embodiment has been described with reference to a two-circuit, four-terminal, chip-type common mode choke coil (shown in FIG. 1) as an example, the numbers of circuits and terminals are not particularly limited. Thus, the present invention is applicable to a three-circuit, chip-type common mode choke coil having six or more terminals.

Figure 7:
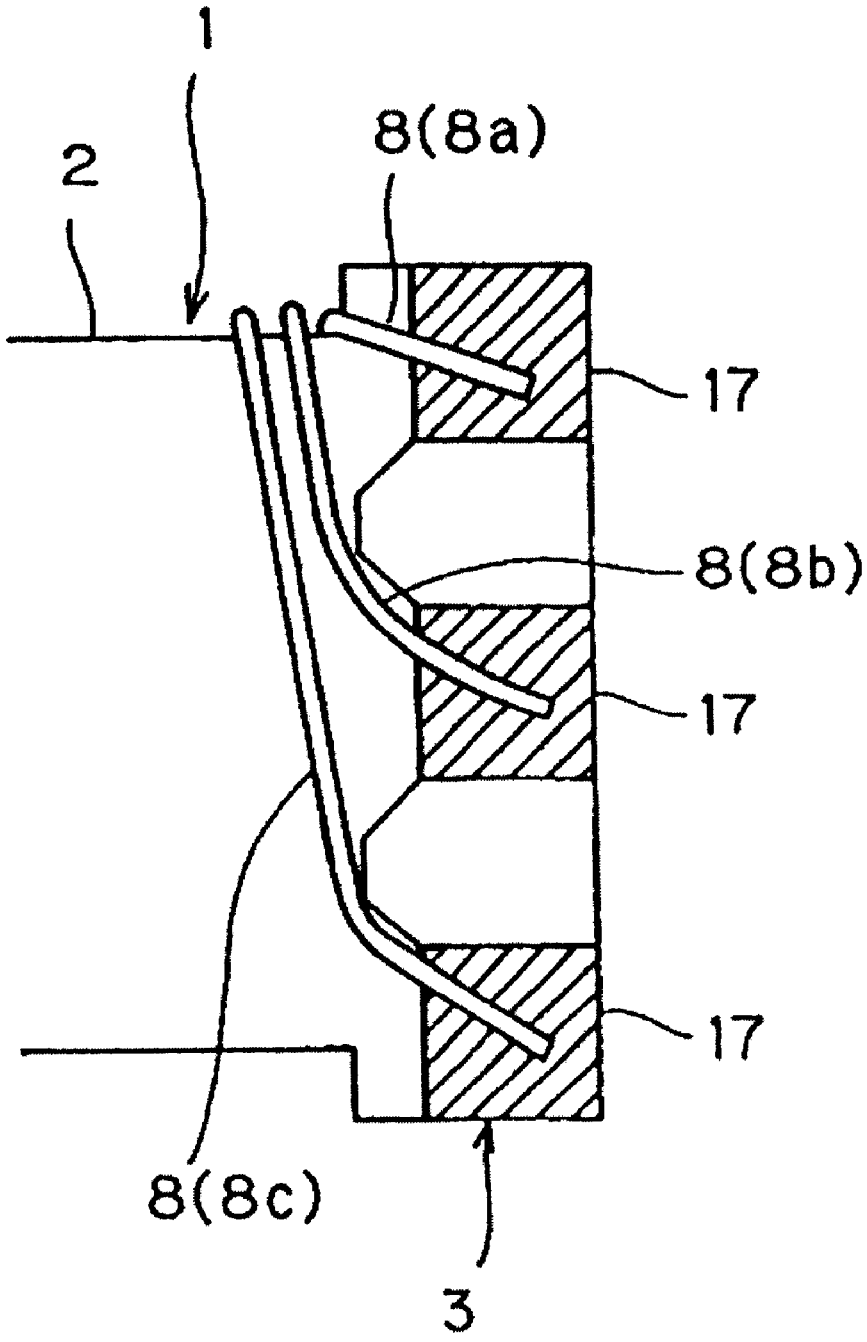
FIG. 7 is a bottom view of a modification of a preferred embodiment of the chip-type common mode choke coil in accordance with the present invention.
Figure 8A:
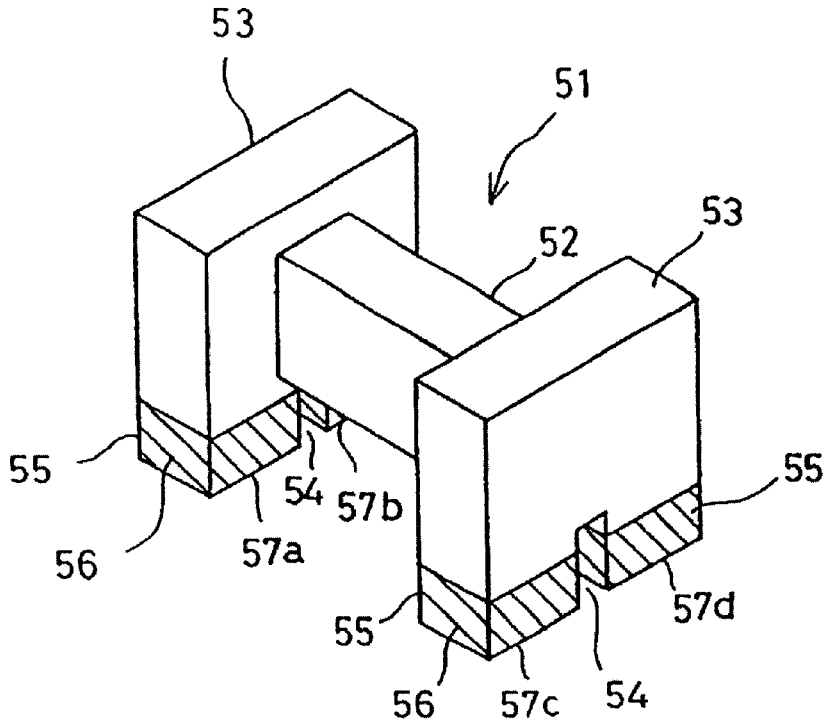
Fig.8a PRIOR ART
FIGS. 8A and 8B are perspective views illustrating a core used for a conventional chip-type common mode choke coil from different angles.
Figure 8B:
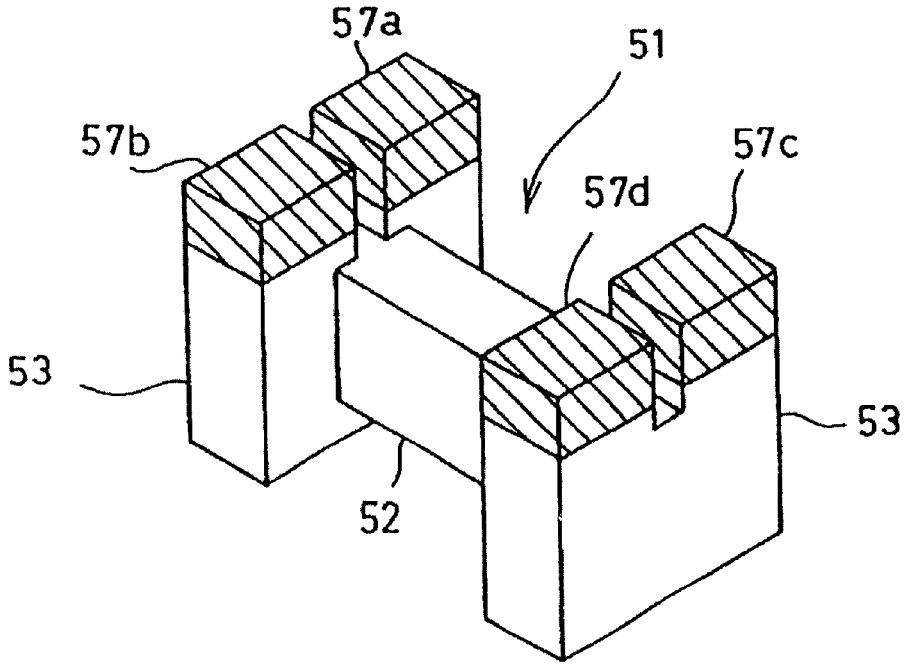
Fig.8b PRIOR ART
Figure 9:
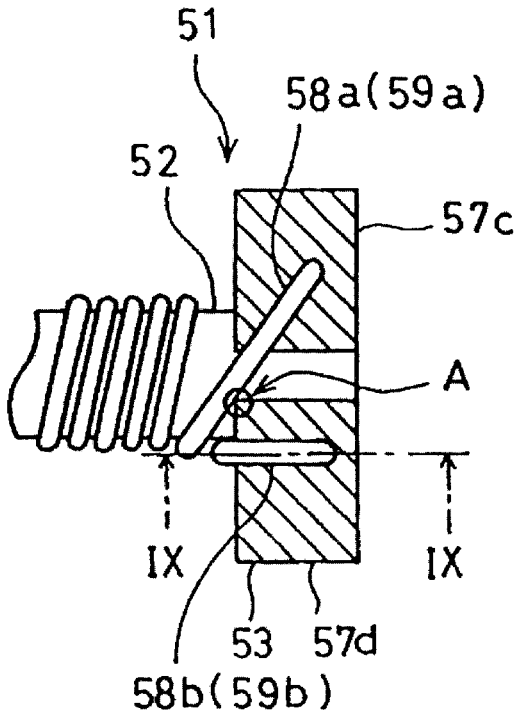
Fig.9 PRIOR ART
FIG. 9 is a bottom view of the main portion of the conventional chip-type common mode choke coil formed by winding wires upon the core shown in FIGS. 8A and 8B.
Figure 10:
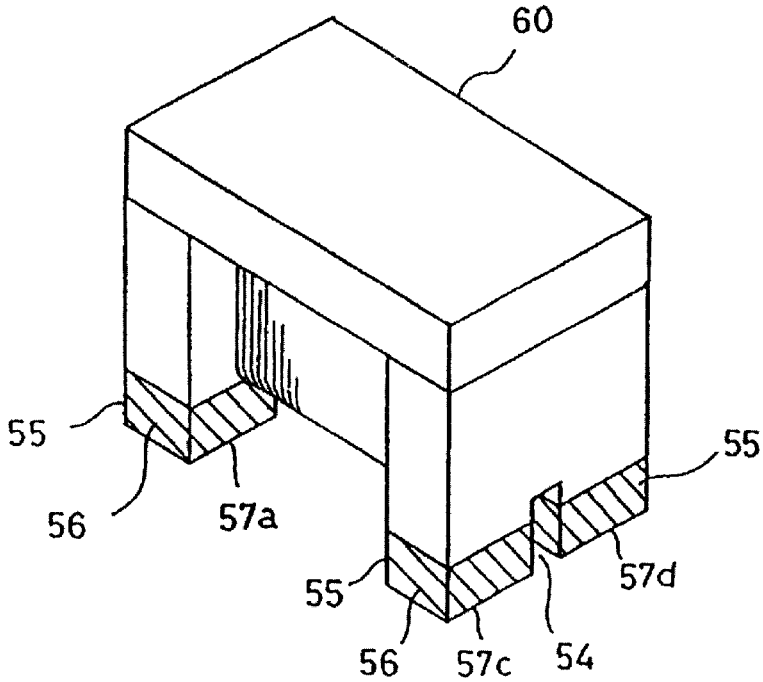
Fig.10 PRIOR ART
FIG. 10 is a perspective view of the conventional chip-type common mode choke coil including the core shown in FIGS. 8A and 8B.
Figure 11:
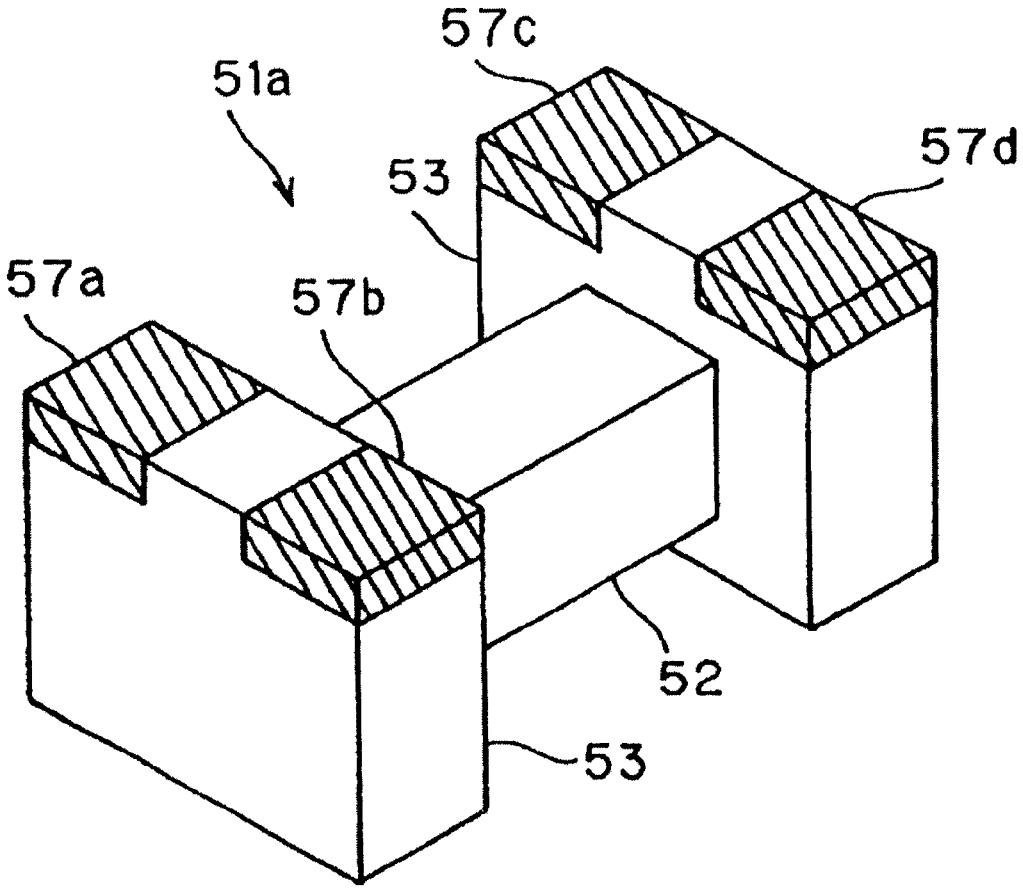
Fig.11 PRIOR ART
FIG. 11 is a perspective view of another example of the core used for the conventional chip-type common mode choke coil.
Figure 12:
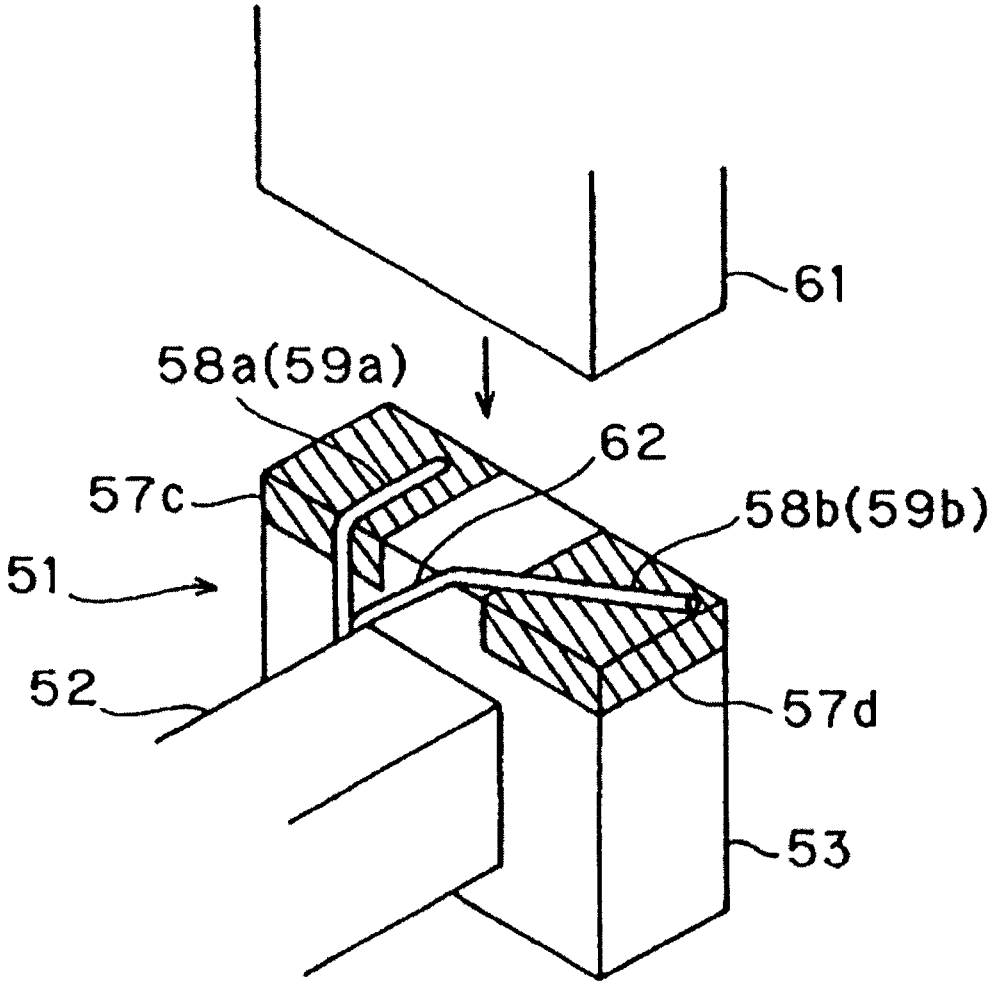
Fig.12 PRIOR ART
FIG. 12 illustrates the structure of the connection of the wires to electrodes provided on the core shown in FIG. 11.
Figure 13:
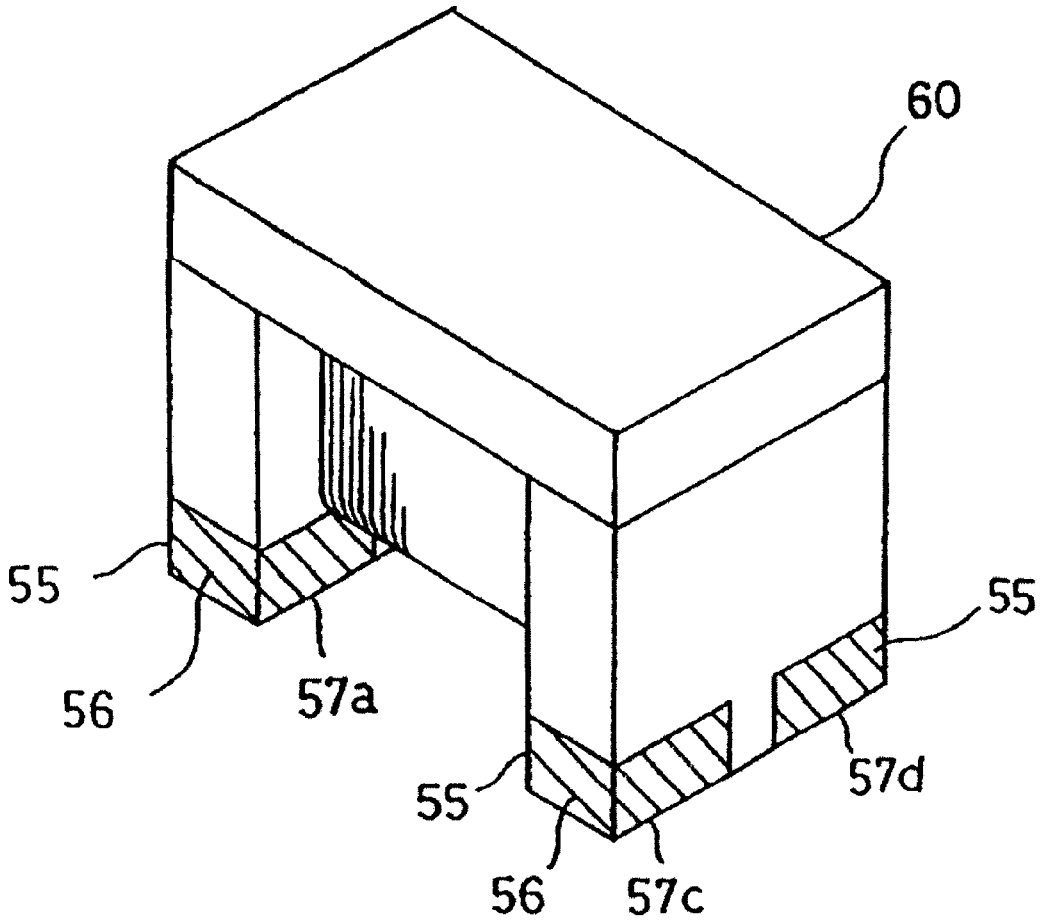
Fig.13 PRIOR ART
FIG. 13 is a perspective view of another kind of a conventional chip-type common mode choke coil using the core shown in FIG. 11.

FIG. 7 is a bottom view of a three-circuit, six-terminal, chip-type common mode choke coil of another preferred embodiment of the present invention. This chip-type common mode choke coil preferably includes three wires 8*a*, 8*b*, and 8*c* which are wound upon a winding core portion 2 of a core 1, and which are arranged to be connected to three corresponding electrodes 17 disposed on flanges 3, one being provided on each end of the core 1 (only one of the flanges is shown in FIG. 7). Protrusions 20 that are substantially trapezoidal in plan view are provided in the areas between the corresponding adjacent electrodes 17.

Even in the three-circuit, six-terminal, chip-type common mode choke coil, since the protrusions 20 are interposed in the areas between the corresponding electrodes 17, respectively, at the inside surfaces of the flanges 3, it can prevent, like the above-described two-circuit, four-terminal, chip-type common mode choke coil, the occurrence of a short circuit failure and a reduction in insulation resistance. In addition, it has legs with excellent mechanical strength, and provides high reliability.

Although in the above-described preferred embodiments, the cores are described as preferably being made of ferrite materials, the materials of which the cores are made are not limited thereto, so that, for example, various magnetic materials and insulating materials including alumina may also be used.

The present invention is not limited to the above-described preferred embodiments as regards other points, so that various applications and modifications may be made within the gist of the present invention including how the wires are wound, the particular forms of the electrodes, the winding core portions, and the flanges.

In the basic form of the chip-type common mode choke coil of various preferred embodiments of the present invention, protrusions which protrude in the axial direction of the winding core portion are preferably disposed in the areas between the corresponding electrodes, at the inside surfaces of the flanges, so that the stroke distances between the adjacent electrodes can be increased, and the adjacent electrodes can be separated from each other by the corresponding protrusions. Therefore, it is possible to reliably prevent the wires from coming into contact with not only the electrodes to which they are primarily to be connected, but also with the electrodes adjacent thereto.

Therefore, even in the case where not only the portions of the films of the wires which are connected to the electrodes, but also nearby portions thereof are removed when the wires are joined to the corresponding electrodes, for example, by pushing a high-temperature heater chip against the wires, it is possible to prevent the occurrence of a short circuit caused by the wires coming into contact with the corresponding electrodes adjacent thereto, and the occurrence of reduced insulation resistance. Therefore, it is possible to obtain a highly reliable chip-type common mode choke coil.

Since the cross-sectional areas of the flanges (that is, the legs) become larger in correspondence with the protrusions, it is possible to obtain a highly reliable chip-type common mode choke coil having excellent mechanical strength.

The shape of the protrusion disposed on each of the flanges is not particularly limited. However, when it is at least one of a substantially triangular shape, a substantially square shape, a substantially rectangular shape, a substantially trapezoidal shape, and a substantially semicircular shape in plan view, it is possible for the protrusions to increase the stroke distances between adjacent electrodes, to reliably separate the adjacent electrodes, and to prevent the occurrence of short circuits caused by the wires not only coming into contact with the electrodes to which they are primarily to be connected, but also with the electrodes adjacent thereto. Therefore, the present invention can be more effectively carried out.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A chip-type common mode choke coil comprising:

a winding core portion;

flanges disposed on both ends of the winding core portion, respectively;

a plurality of electrodes disposed on each of the flanges at a predetermined distance from each other so as not to come into electrical conduction with each other; and a plurality of wires wound upon the winding core portion, beginning ends and termination ends of the wires being connected to predetermined ones of the plurality of electrodes; wherein protrusions which protrude in an axial direction of the winding core portion are provided in areas between the respective electrodes, at inside surfaces of the respective flanges disposed on both ends of the winding core portion.

2. A chip-type common mode choke coil according to claim 1, wherein the shape in plan view of the protrusion provided on each flange is at least one of a substantially triangular shape, a substantially rectangular shape, a substantially square shape, a substantially trapezoidal shape, and a substantially semicircular shape.

3. A chip-type common mode choke coil according to claim 1, wherein the chip-type common mode choke coil is a two-circuit, four terminal, chip-type common mode choke coil.

4. A chip-type common mode choke coil according to claim 1, wherein the chip-type common mode choke coil is a a three-circuit, six-terminal, chip-type common mode choke coil.

5. A chip-type common mode choke coil according to claim 1, wherein the core is made of ferrite.

6. A chip-type common mode choke coil according to claim 1, wherein the protrusions have substantially trapezoidal shapes.

7. A chip-type common mode choke coil according to claim 1, wherein the protrusions have substantially semicircular shapes.

8. A chip-type common mode choke coil according to claim 1, wherein the protrusions have substantially triangular shapes.

9. A chip-type common mode choke coil according to claim 1, wherein the protrusions have substantially rectangular shapes.

10. A chip-type common mode choke coil according to claim 1, wherein the wires extend along the protrusions in a relatively gradually bent state.

11. A chip-type common mode choke coil comprising:

a winding core portion;

a plurality of flanges disposed on respective ends of the winding core portion;

a plurality of electrodes disposed on each of the flanges and arranged so as not to come into electrical conduction with each other;

a plurality of wires wound upon the winding core portion and having first and second ends being electrically connected to a respective one of the plurality of electrodes; and a plurality of protrusions provided in areas between the respective electrodes, at inside surfaces of the respective flanges disposed on both ends of the winding core portion.

12. A chip-type common mode choke coil according to claim 11, wherein the shape in plan view of the protrusion provided on each flange is at least one of a substantially triangular shape, a substantially rectangular shape, a substantially square shape, a substantially trapezoidal shape, and a substantially semicircular shape.

13. A chip-type common mode choke coil according to claim 11, wherein the chip-type common mode choke coil is a two-circuit, four terminal, chip-type common mode choke coil.

14. A chip-type common mode choke coil according to claim 11, wherein the chip-type common mode choke coil is a a three-circuit, six-terminal, chip-type common mode choke coil.

15. A chip-type common mode choke coil according to claim 11, wherein the core is made of ferrite.

16. A chip-type common mode choke coil according to claim 11, wherein the protrusions have substantially trapezoidal shapes.

17. A chip-type common mode choke coil according to claim 11, wherein the protrusions have substantially semicircular shapes.

18. A chip-type common mode choke coil according to claim 11, wherein the protrusions have substantially triangular shapes.

19. A chip-type common mode choke coil according to claim 11, wherein the protrusions have substantially rectangular shapes.

20. A chip-type common mode choke coil according to claim 11, wherein the wires extend along the protrusions in a relatively gradually bent state.

* * * * *